US008073176B2

(12) United States Patent
Bottum

(10) Patent No.: US 8,073,176 B2
(45) Date of Patent: Dec. 6, 2011

(54) SPEAKERBAR

(76) Inventor: Bernard Bottum, Macedonia, OH (US)

( * ) Notice: Subject to any disclaimer, the term of this patent is extended or adjusted under 35 U.S.C. 154(b) by 496 days.

(21) Appl. No.: 12/348,533

(22) Filed: Jan. 5, 2009

(65) Prior Publication Data

US 2009/0175476 A1 Jul. 9, 2009

Related U.S. Application Data

(60) Provisional application No. 61/018,914, filed on Jan. 4, 2008.

(51) Int. Cl.
*H04R 25/00* (2006.01)

(52) U.S. Cl. ..... 381/335; 381/332; 381/182

(58) Field of Classification Search ..... 381/300–311, 381/332–336, 345–348, 350, 182, 388
See application file for complete search history.

(56) References Cited

U.S. PATENT DOCUMENTS 5,321,756 A * 6/1994 Patterson et al. ..... 381/308
5,850,460 A * 12/1998 Tanaka et al. ..... 381/335
7,260,235 B1 * 8/2007 Henricksen et al. ..... 381/335
7,624,839 B1 * 12/2009 Graber ..... 381/335

* cited by examiner

*Primary Examiner* — Suhan Ni
(74) *Attorney, Agent, or Firm* — Gifford, Krass, Sprinkle, Anderson & Citkowski, P.C.

(57) ABSTRACT

The present invention introduces a speakerbar which mounts above or below a flat screen TV and reproduces the surround sound experience normally associated with speakers placed in five to seven separate locations around the room.
This particular invention effectively increases the perceived stereo separation of the left and right front speakers, and creates the perception of two and even four surround speakers typically placed in the rear of the listening area. In addition, it introduces new technology to achieve multichannel bass extension beyond the normal limitations due to the minimal internal volume of a multichannel speakerbar.

8 Claims, 2 Drawing Sheets

SPEAKERBAR

CROSS REFERENCE TO RELATED APPLICATIONS

This application claims priority of U.S. Provisional Patent Application Ser. No. 61/018,914 filed Jan. 4, 2008, which is incorporated herein by reference.

BACKGROUND OF THE INVENTION

I. Field of the Invention

The present invention relates generally to audio speakers and, more particularly, to a speakerbar for use with a multichannel sound source.

II. Description of Related Art

The rapid emergence of shallow depth flat screen televisions has caused speaker manufacturers to rethink the ideal cosmetic shape of speakers to be used for home theater systems. Such home theater systems are intended to deliver three, five or even seven individual channels of sound with a like number of speakers per channel. Unfortunately, the use of separate speakers for each channel results not only in room clutter, but also difficulties in actually wiring the speakers to the multichannel sound source.

A new speaker design, however, has gained popularity recently, particularly when used with flat screen televisions. The industry term to describe these new speakers is "speakerbar". Speakerbars typically include an elongated housing which fits below or above the television. Typically, the speakerbars have a width of two to four feet, are shallow in depth and short in height to both minimize visual intrusion and complement the flat screen television's shallow depth.

In order to accommodate the built-in internal or external multichannel sound source (receiver or amplifier), these previously known speakerbars have included at least one speaker for each channel of the multichannel sound source. Corresponding inputs on or in the speakerbar housing are provided to electrically connect the multichannel source to its associated speaker. Each individual speaker within or on the housing requires a minimum enclosure volume for a given bass extension. For example: to extend down to 100 Hz, the target high frequency cut-off for a subwoofer would require a housing three times as large as for three similar speakers compared to a housing for a single similar speaker.

The previously known speakerbars, however, suffer from several disadvantages: First, since the speakerbar itself is relatively small, only relatively small speakers may be used. Small speakers, especially those below 5¼" diameter (or 4"×6"), have difficulty extending to 100 Hz (the maximum target crossover to a subwoofer), and reproducing a target of at least 100 decibels of output in the 100 Hz to 250 Hz (lower midrange) spectrum. Secondly, since each lower midrange speaker in the bar needs a minimum air volume to reach 100 Hz (or preferably even lower), there simply is not enough total air volume in the bar. To match properly with a subwoofer, each 5¼" or 4×6" speaker requires a minimum bar housing of approximately 18". The result is that technology used in the previously known speakerbars causes them to fall short of the combination of low frequency response of at least 100 Hz and output of at least 100 decibels when more than two channels are included in the bar. A further disadvantage of the previously known speakerbars is a maximum limitation of five channels, probably due to limitations in the number of speakers which will fit in an acceptably sized enclosure. These five channels include the front left, front center and front right speakers, and left and right rear wall surround speakers. However, in today's technology, the number of sound channels has increased to seven channels by adding left and right side wall surround speakers. Furthermore, an attempt to accommodate seven channel sound by simply adding additional speakers to the speakerbar results in a further reduction of volume allowed for each speaker which further limits the bass response of the speakerbar. The only option with existing technology to reach down to 100 Hz and play at 100 decibels output is to increase cabinet size to unacceptable proportions for most of the population.

Conventionally, separate speakers for the left and right channel have a recommended separation of approximately two-thirds the seating distance from the television screen. If a listener sits the typical ten feet or greater distance from the screen, this would require that the left and right speakers be positioned seven or more feet apart from each other to create the proper soundstage. The previously known speakerbars, however, typically have a width of only two to four feet thus greatly diminishing the preferred width of the soundstage. Furthermore, the general consensus is that the speakerbar should not be wider that the television from an aesthetic standpoint.

SUMMARY OF THE PRESENT INVENTION

The present invention provides speakerbar designs which overcome all of the above-mentioned shortcomings of the previously known speakerbars, in a cosmetically acceptable enclosure. These designs also do not require DSP and, therefore, can be used with conventional and readily available surround receivers and amplifiers.

In brief, the speakerbar of the present invention comprises an elongated housing having a front, a rear and two sides with typically a maximum required size of 5.5" H×5.5" W×24" d for FIGS. 1-4, and 5.5" H×5.5" W×40" L for FIG. 5. An input for each channel of a multichannel sound source is also attached to the housing, or could be accomplished internally with built-in amplification. Consequently, for a five channel speakerbar, the inputs would include the front left, center and right channels, and left and rear wall surround channels. For a seven channel system, the speakerbar would include seven inputs for the additional left and right rear side wall surround channels.

In one application of the invention (FIG. 1), only three fill range, typically 2.5" to 4", triple voice coil speakers are required to reproduce up to seven discrete channels of sound. A triple voice coil full range speaker is mounted to the front baffle so that the sound from this speaker projects forward and towards the listeners from the front baffle. One coil of this front baffle speaker is electrically connected to the front center speaker input while the other two coils are electrically connected to the left and right front speaker inputs. Consequently, the total sound produced by the front baffle speaker is an aggregate of the electrical signal intended for the left front, center channel and right front speakers. This delivers sound which, for the most part, reaches the listener's ears before it is reflected off walls, ceiling, and floor.

For the application in FIG. 1, in addition to a single speaker positioned on the front baffle, a speaker is mounted to the left and right ends of the speakerbar. Furthermore, the speakers are positioned relative to the housing so that the sound emanating from these end speakers projects rearwardly and to the sides relative to the front of the speakerbar housing. They are positioned in a manner so that for the most part, the sound reaches your ears after it is reflected off walls, ceiling, and floor, with best results when a significant portion is reflected off the rear wall.

For a five channel application, both the left and right end speakers use dual voice coils. One coil for the speaker positioned at the left end is connected to the left front channel input terminal, as well as one of the coils on the front baffle speaker, while the other coil for the left end speaker is connected to the left surround channel input. Similarly, one coil for the speaker positioned at the right end is electrically connected to the right front channel input while the other coil for the right end speaker is electrically connected to the right surround input. For a seven channel application the left and right end speakers use triple voice coils and the left and right side wall surround channel inputs are respectively connected to the third coil of the left and right end speakers. A variation of this design could replace the triple voice coil front baffle speaker with three single voice coil front baffle speakers. The left front baffle speaker would be combined with one of the left end speaker voice coils and the right front baffle speaker would be combined with one of the right end speaker voice coils. The remaining front baffle center speaker would be connected to the center input terminal. Any/all of the fill range speakers could also be combined or in combination with a tweeter(s) for extended high frequency response. The unique result with any of these designs is first, that more than one channel can be accomplished with one driver, and up to three channels can be accomplished with a triple voice coil speaker, saving space, cost, and cabinet volume to achieve improved bass extension and output. This is a profound new technology for the size and air volume limitation of the speakerbars. At the same time, this invention adds additional reflected sound to the right and left front side walls in combination with direct sound from the forward-facing speaker(s) which results in significant soundstage expansion, while maintaining the clarity which only forward-facing speakers can achieve. Due to speakerbar space limitations, it would be impossible to accomplish all of this with multiple speakers on the ends of the speakerbar; however, it is possible with the multiple voice coil technology of this invention. In conclusion, conventional use of multiple drivers is largely replaced by multiple voice coils, and the heretofore lost soundstage is retrieved by a combination of forward facing plus reflected sound for the left and right front channels. As the state of the art advances, additional channels could be achieved by going beyond three voice coils, to four voice coils, etc. using an extension of this invention.

Unlike the previously known speakerbars, the speakerbar of the present invention (FIG. 1) accommodates discrete five or seven channel surround sound while using as few as three speakers. This not only saves space and cost, but also enables audio reproduction down to and even below 100 hertz with 100 decibel output in a minimum housing volume.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF TEE PRESENT INVENTION

Figure 1:
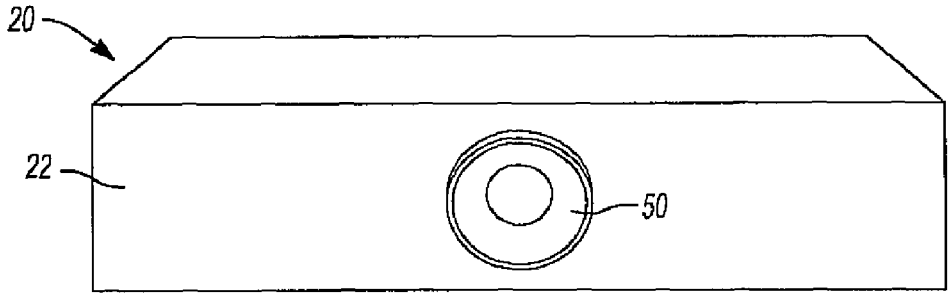
FIG. 1 is a front view illustrating a first preferred embodiment of the present invention.
Figure 2:
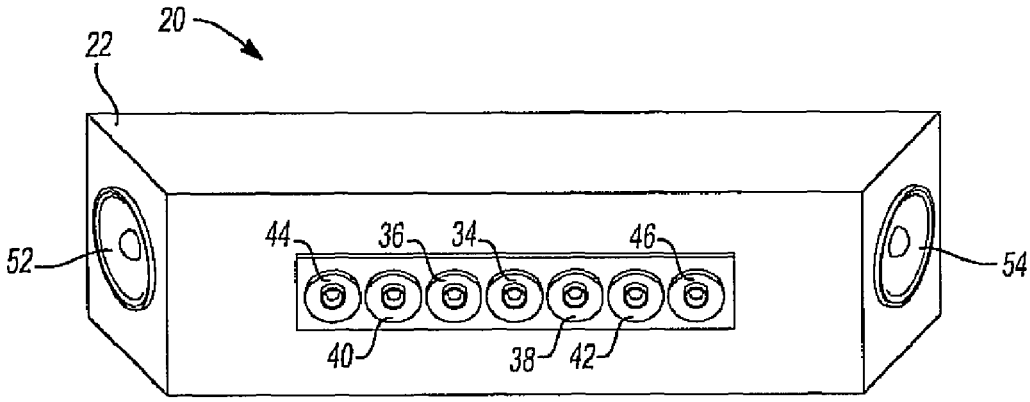
FIG. 2 is a rear view illustrating the first preferred embodiment of the present invention.
Figure 3:
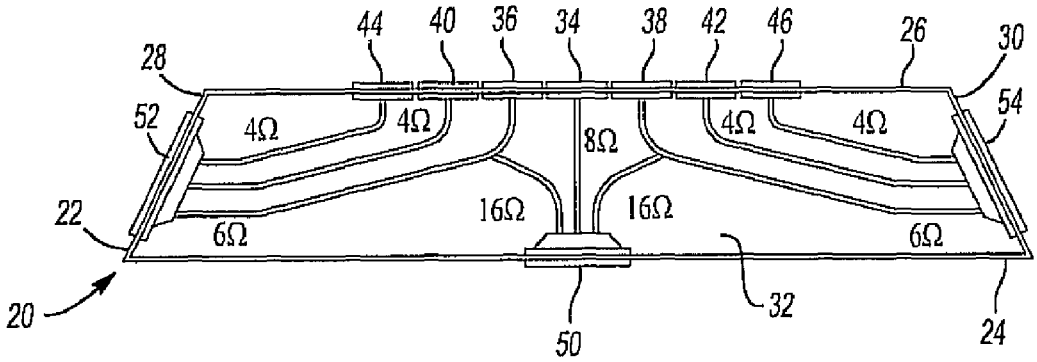
FIG. 3 is a top view illustrating the first preferred embodiment of the present invention.

With reference first to FIGS. 1-3, a first preferred embodiment of a speakerbar 20 of the present invention is shown which may be used with a three channel, five channel, seven channel or greater sound source. The speakerbar 20 includes an elongated housing 22 having a front 24, a rear 26, a left side 28 and a right side 30. The top and bottom of the housing 22 will also close the housing 22 thus forming a speaker volume 32, in this example of about 24".

As best shown in FIGS. 2 and 3, an input terminal or electrical connector is provided for each channel of the multichannel sound source. Thus, as shown in FIG. 3, these electrical connectors include a center channel connector 34, a left front channel connector 36, a right front channel connector 38, left and right rear wall (5.1) surround channel connectors 40 and 42, respectively, and the addition of left and right rear side surround channel (7.1) connectors 44 and 46, respectively.

A center channel speaker 50 is mounted to the front 24 of the housing 22 so that sound from the speaker 50 projects forwardly from the housing front 24. Conversely, a left side speaker 52 is connected to the left end 28 of the housing 22 while a right speaker 54 is connected to the right end 30 of the housing 22. Alternatively, the left speaker 52 and right speaker 54 may be mounted to the rear 26 of the housing 22. In either event, the left speaker 52 and right speaker 54 are oriented relative to the housing front 24 so that the left and right speakers 52 and 54, respectively, project sound to the rear and sides relative to the front 24 of the housing 22.

As best shown in FIG. 3, the center speaker 50 is a triple voice coil speaker in which each voice coil is independent of the other two.

One voice coil of the speaker 50 is connected directly to the center channel input 34. The other two voice coil inputs are connected respectively one to the left main channel input 36 and one to the right front channel input 38. Consequently, the sound projected by the center speaker 50 consists of an aggregate of the signals from the left channel input 36, center channel input 34 and right channel input 38. The electrical impedance controls the relative contribution of each channel to the overall sound from the front speaker. For example, as shown in FIG. 2, the voice coil for the connection to the center channel input 34 is shown as eight ohms while the impedance for the left and right channels are shown as sixteen ohms each. This invention uniquely uses variation of impedances to replace electrical components to create the desired balance in output.

The left side speaker 52 is also a triple voice coil speaker and thus also has three independent voice coils. One voice coil is connected to the left front input 36, a second voice coil is connected to the left rear wall surround input 40 and the third coil is connected to the left rear side wall surround input 44.

Similarly, the right speaker 54 is also a triple voice coil speaker having its three coils connected to the right front channel 38; right rear surround channel input 42 and right rear second surround channel input 46.

The front baffle speaker 50 produces and projects sound directly towards the intended listening area for the front left, center, and right channels. Conversely, the left and right end speakers project sound primarily to the rear and side walls, and when used in combination with the front baffle speaker 50, create the front left, right channel soundstage expansion. Since the left speaker 52 and right speaker 54 are angled rearwardly away from the front 24 of the housing 22, sound from the speakers 52 and 54 will primarily reach the listener through reflected sound initiating from behind the speakerbar 20 and along the rear side walls. Such predominantly reflected sound also closely resembles the surround channel envelopment of separate speakers positioned to the rear of the listening room.

Figure 4:
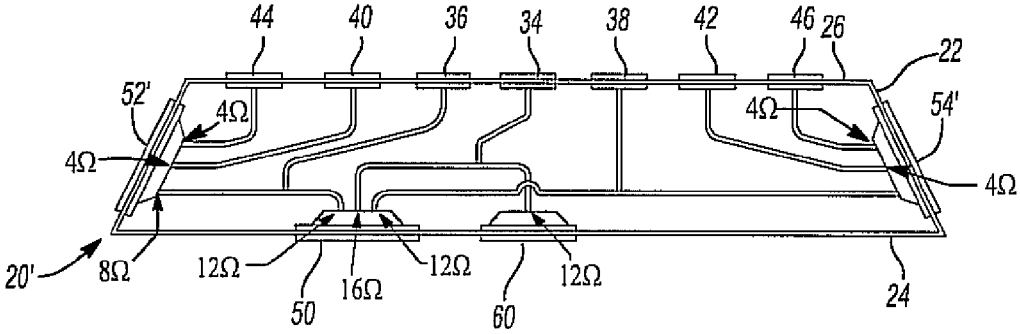
FIG. 4 is a view similar to FIG. 3, but illustrating a modification thereof with deeper bass.

With reference now to FIG. 4, a modification of the present invention is shown which is specifically designed for a three, five, or seven channel system, with the addition of enhanced upper bass/lower midrange, and using a two-way design.

The speakerbar 20 shown in FIG. 4 also includes an upper bass/lower midrange triple voice coil (4"×6") speaker 51 which is larger than the others (50, 52, 54) and provides the lower midrange/upper bass extension for the right and front as well as the center channel, utilizing the full cabinet volume, except for the small enclosures around 50, 52, and 54. Triple voice coil speaker (51) provides significantly more bass extension and upper bass output in this size housing compared to sharing the cabinet with two or three similar speakers. In this application, separate small housings should enclose 50, 52 and 54. As before, the three coils of speaker 50 are electrically connected to the left front input 36, right front input 38 and center channel input 34. However, in addition to the center speaker 50, the triple channel upper bass/lower midrange 51 is also mounted to the front 24 of the housing 22. This is connected to the center channel input 34 and, together with the speaker 50, provides the sound projecting forwardly from the front 24 of the speakerbar housing 22.

Still referring to FIG. 4, a three channel (only) version could be designed using only a single voice coil speaker for 52 and 54. If a maximum of five channels were desired, dual voice coil speakers could be used for 52 and 54. From a value standpoint, whether only three or five or seven channels are used, all speakers are operative and contributing to the sound. If someone were to use these versatile multichannel designs with separate surround speakers, they would simply not connect wires to the corresponding connectors on the back of the speakerbar. The left front channel input 36, the left rear surround channel 40 and the left side surround channel 46 are connected to the separate coils of the left speaker 52 while, similarly, the right front channel input 38 is electrically connected to one coil of the right speaker 54 while the right rear surround channel input 42 is electrically connected to the other coil of the right speaker 54 and the right side rear channel surround 44 is connected to the remaining coil of the right speaker. Otherwise, the operation of the speakerbar 20 illustrated in FIG. 4 is substantially the same as the speakerbar 20 illustrated in FIGS. 1-3.

Figure 5:
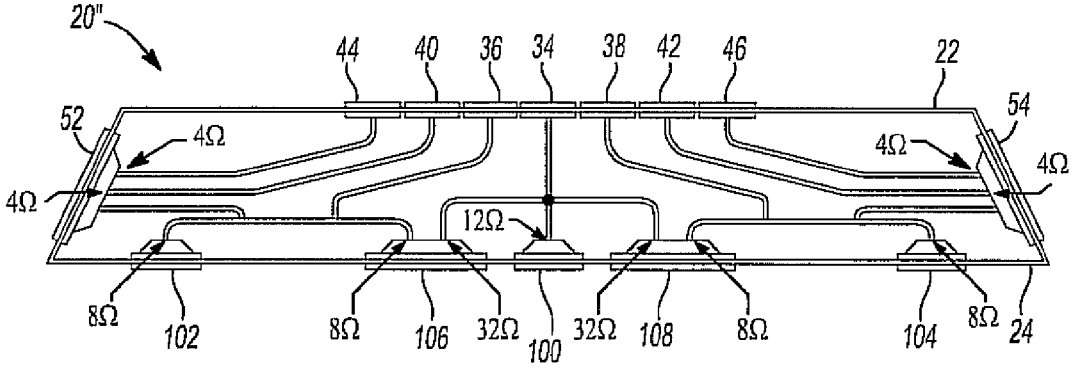
FIG. 5 is a view similar to FIGS. 3 and 4, but illustrating a still further modification thereof

With reference now to FIG. 5, a still further embodiment of a speakerbar 20 is illustrated for a three, five or seven channel sound source. As such, the speakerbar 20 includes the channel inputs 34-46 for each of the up to seven channels of sound.

The speakerbar 20 is similar to the embodiment shown in FIGS. 1-4 but in a wider (40") cabinet. It includes a left speaker 52 and right speaker 54. Both of these speakers use triple voice coils and the surround channels are wired in the same fashion as shown in FIG. 3.

The speakers mounted to the front baffle 24 of the housing 22, however, differ somewhat from the prior embodiments of the invention. Specifically, the front speakers include a single voice coil center channel tweeter 100 which is connected only to the center channel input 34. A single voice coil left tweeter 102 has its coil directly connected to the left channel input 36 while a single voice coil right tweeter 104 at the opposite end of the housing 22 has its voice coil electrically connected to the right channel input 38. Consequently, these three tweeters 100, 102 and 104 provide the relatively high frequency audio output for the front left channel, right channel and center channel, for improved clarity and high frequency extension.

Still referring to FIG. 5, a left upper bass/midrange speaker 106 is also mounted to the housing front baffle 24 between the center tweeter 100 and the left front tweeter 102. Similarly, a second upper bass/midrange speaker 108 is also mounted to the front 24 of the housing 22 between the right front tweeter 104 and the center tweeter 100. Both of these speakers 106 and 108, furthermore, are larger in size than the tweeters 100-104, and the full range speakers in FIGS. 1-3 and thus reproduce lower midrange and upper bass frequencies more accurately than the tweeters 102 and 104, or the fill range speakers in FIGS. 1-3.

The left front speaker is a dual voice coil speaker having one voice coil connected to the center channel input 34 and its other voice coil connected to the left channel input 36. Similarly, the right front speaker 108 is also a dual voice coil speaker having one voice coil connected to the center channel input 34 and its other voice coil connected to the right channel input 38. Consequently, the left front speaker 106 produces the mid and low frequency output for both the front left channel and part of the center channel, while the right front speaker 108 produces the mid and low frequency output for the right front channel and part of the center channel.

In practice, the embodiment of the invention illustrated in FIG. 5 produces wider range response and greater output for the signals projected by the speakers on the front baffle of the housing, 24.

It will be appreciated, of course, that to achieve the optimum overall balance the impedances of each of the voice coils will be varied as necessary to control the amount of current flowing to that particular speaker, since amplifiers deliver more current to low impedances than high impedances. For example, in the embodiment of the invention illustrated in FIG. 3, the speaker coils for the speaker 50 connected to the left and right channels have an impedance of 16 ohms while the coil connected directly to the center channel has a lower impedance, e.g. 8 ohms. Consequently, for the same signal strength relatively more current flows from the center channel to the speaker 50 than from each of the left and right channel inputs so that the center channel contributes more to the overall sound projected by the speaker 50. The impedances for the other speakers in all of the embodiments of the invention are all precisely selected to determine the degree of contribution to the overall sound resulting from signals from the various inputs on the speakerbar.

From the foregoing, it can be seen that the present invention provides a more cost effective and superior performing speakerbar capable of producing enveloping surround sound using separate enclosures physically spaced around the listening room. To achieve this, the left and right end speakers produce all of the surround sound by reflecting off the rear and side walls, while the front speaker(s) produces the direct sound. Furthermore, by using multiple voice coil speakers, the number of speakers can be minimized thus increasing the relative housing volume per speaker which uniquely enhances bass performance of the speakerbar.

Having described my invention, however, with breakthroughs in soundstage expansion and bass extension using new techniques for combining direct and reflected sound and the incorporation of single multi voice coil speakers to replace multiple separate speakers, provides many possible new variations and adaptations are introduced to those skilled in the art to which it pertains without deviation from the spirit of the invention as defined by the scope of the appended claims.

I claim:

1. A speakerbar for a multichannel sound source comprising:

an elongated housing having a front, a rear and two sides, an input for each channel of the multichannel sound source, said inputs including a center channel input, left and right front channel inputs and left and right surround channel inputs, at least one front baffle speaker mounted in said front wall of said housing so that sound from said front baffle speaker is projected forwardly of said housing front, at least one left side speaker and at least one right side speaker mounted in either said rear or said sides of said housing so that sound from said side speakers is projected in a non-forward direction of said housing front, wherein said left side speaker includes at least two coils, one said left coil input connected to said left front channel input and another left coil input connected to said left surround channel input, and wherein said right side speaker includes at least two coils, one said right coil input connected to said right front channel input and another right coil input connected to said right surround channel input.

2. The invention as defined in claim 1 wherein said at least one center surround speaker includes at least three coils, one front baffle speaker coil electrically connected to said center channel input and the other two front baffle speaker coils electrically connected to said left and right channel inputs, respectively.

3. The invention as defined in claim 1 wherein said left and right surround inputs include left front and rear surround inputs and right front and rear surround inputs, and wherein said left speaker includes three coils two of which are connected to said left front and rear surround inputs and wherein said right speaker includes three coils two of which are connected to said right front and rear surround inputs.

4. The invention as defined in claim 1 wherein said side speakers are mounted in said sides of said housing, said sides of said housing being angled rearwardly from said front of said housing.

5. The invention as defined in claim 1 wherein said front baffle speaker comprises a main front baffle speaker and a single coil front tweeter, said tweeter coil being connected to said center channel input.

6. The invention as defined in claim 5 wherein said main front baffle speaker further comprises a double coil front left speaker having its coils connected to the left front channel input and center channel input and a double coil front right speaker having its coils connected to the right front channel input and center channel input.

7. The invention as defined in claim 6 and comprising a single coil left front tweeter having its coil connected to the left front channel input and a single coil right front tweeter having its coil connected to the right front channel input.

8. The invention as defined in claim 1 wherein at least one of said speakers is oval in shape.

* * * * *